United States Patent [19]

Perng

[11] Patent Number: 4,535,684

[45] Date of Patent: Aug. 20, 1985

[54] VENTILATION SYSTEM FOR AN ENCLOSED SPACE

[76] Inventor: Guu Perng, No. 15, Lane 129, Kee-Chin 1 Rd., Kee Lung City, Taiwan

[21] Appl. No.: 643,052

[22] Filed: Aug. 22, 1984

[51] Int. Cl.[3] ..... F24F 7/00

[52] U.S. Cl. ..... 98/31; 98/33.1; 98/40.18

[58] Field of Search ..... 98/31, 33 R, 40 N

[56] References Cited

U.S. PATENT DOCUMENTS

| | | | |
|---|---|---|---|
| 2,184,484 | 12/1939 | Bojner | 98/33 R |
| 3,049,067 | 8/1962 | Claude | 98/33 R |
| 3,223,018 | 12/1965 | Tucker, Sr. | 98/33 R |
| 3,294,480 | 12/1966 | Potapenko | 98/33 R |
| 4,135,440 | 1/1979 | Schmidt et al. | 98/31 |
| 4,201,121 | 5/1980 | Brandenburg, Jr. | 98/33 R |

*Primary Examiner*—Ronald C. Capossela
*Attorney, Agent, or Firm*—McGlew and Tuttle

[57] ABSTRACT

A ventilation system for an enclosed occupied space, such as house, school, large building, etc., comprising a fresh air inlet and a fresh air passage provided at the lower side of vertical hollow walls, the fresh air passage having a plurality of fresh air outlet for supplying fresh air into the space, a plurality of exhaust air inlets provided on the ceiling of the space, a first exhaust air discharge passage communicated with the exhaust air inlets and lies in the ceiling, a second exhaust air discharge passage communicated with the first discharge passage and lies in a vertical wall, and an exhaust air outlet at the top of the second exhaust air passage.

8 Claims, 7 Drawing Figures

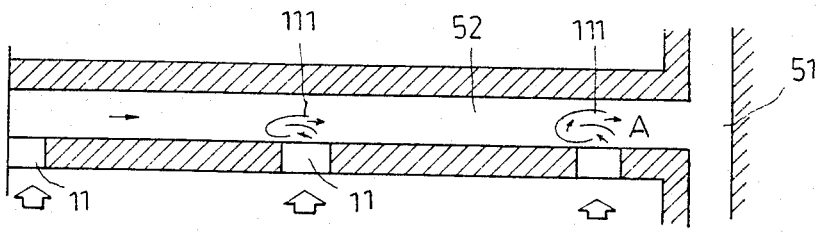
FIG. 4-B
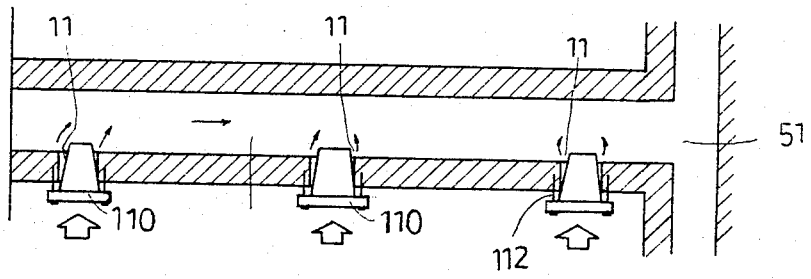
FIG. 4-A
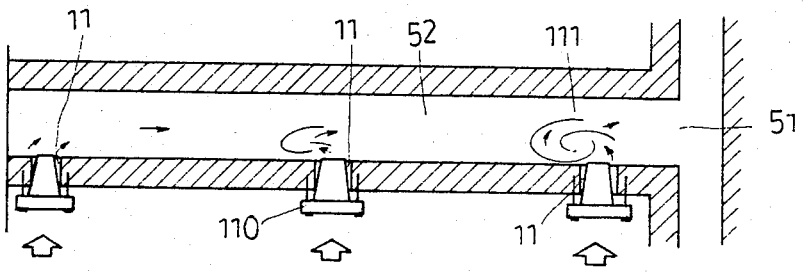
FIG. 4-C

VENTILATION SYSTEM FOR AN ENCLOSED SPACE

BACKGROUND OF THE INVENTION

This invention relates to a ventilation system, particularly to a natural ventilation system for an enclosed space, such as, home, school or large commercial and industrial building which includes fresh air inlets and fresh air supply ducts at the lower side of the wall and exhaust air discharge duct and exhaust air inlet ports for drawing the warm air into the discharge ducts provided in the ceiling of the room. The hot electric appliances and the heat of the human bodies provide a motivative force to the room air to rise into the discharge ducts and the high density and cold fresh air is drawn into the room.

SUMMARY OF THE INVENTION

An object of the invention is to provide an improved natural ventilation system for an enclosed space which can provide adequate ventilation to all parts of the space.

The foregoing and other objects can be achieved in accordance with the invention through the provision of a ventilation system for an enclosed space having hollow walls which comprises a fresh air inlet and a fresh air passage in the lower side of vertical walls, a plurality of fresh air outlet for supplying the fresh air into the space communicated with the fresh air passage, a plurality of exhaust air inlets provided in the ceiling of the space, a first exhaust air discharge passage communicated with said air inlets and lies in the ceiling, a second exhaust air discharge passage communicated with said first discharge passage and lies in a wall, and an exhaust air outlet at the top of said second exhaust air passage.

The ventilation system may further comprises means for preventing backdraft at the exhaust air outlet. The means may includes a roof-shaped member having two flow regulating arrangements for the escape of the exhaust air. Each of the arrangements has a plurality of slats overlapping each other. The two arrangements are provided oppositely and is arranged in such a manner that when one arrangement fully closed, another arrangement will fully open.

In accordance with one aspect of the invention, the system may includes a fan provided where the first and second air discharge ducts meet.

In accordance with another aspect of the invention, the system may includes means for obstructing the communication between the first and second air discharge passages.

In still further aspect of the invention, the system may further comprise a device at the fresh air inlet which includes damper plates, an air filter, a noise absorber and a plurality of water pan.

The presently exemplary preferred embodiment will be described in accordance with the accompanying drawings, in which:

BRIEF DESCRIPTION OF THE DRAWINGS

FIG. 4A is a schematic view illustrating plug members used for regulating the rate of exhaust air to flow through the exhaust air inlets;

FIG. 4B is a schematic view illustrating baffle plates for regulating the rate of the exhaust air at the exhaust air inlets;

FIG. 4C is a schematic view illustrating the combined plug members and baffle plates.

DETAILED DESCRIPTION OF THE PREFERRED EMBODIMENT

Figure 1:
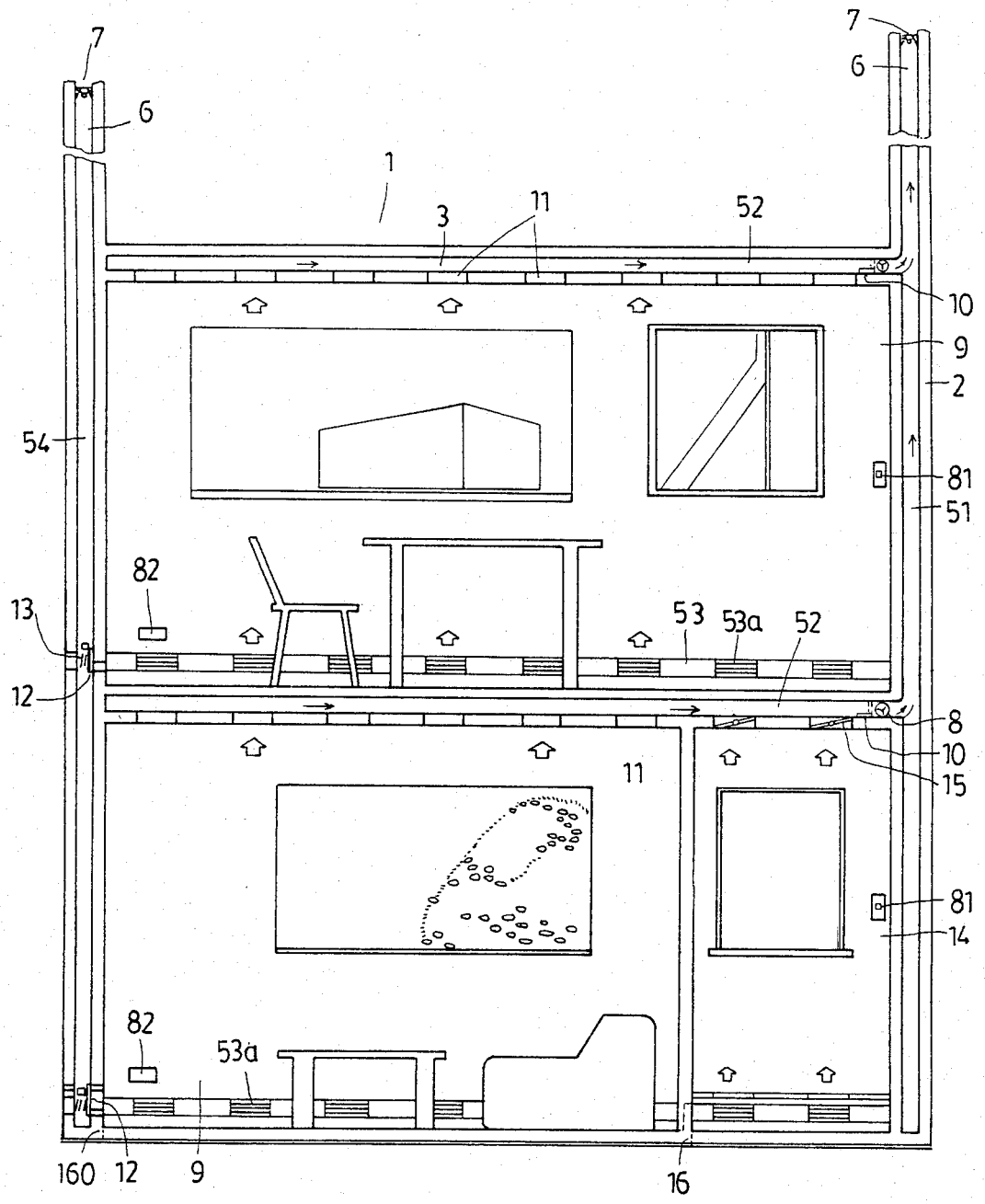
FIG. 1 is a schematic view illustrating a ventilation system of a house of two storeies.

Referring to FIG. 1, there is shown a house 1 of two storeys in which the ceiling 3 of each storey 9 are provided with horizontal exhaust air discharge ducts 52. In the vertical wall 2 of each storey is provided a vertical exhaust air discharge duct 51. The duct 51 is extending from the first storey to the second storey and is communicated with the ducts 52 of two storeys. At the uppermost of the duct 51 is an outlet 6 with a device 7 for preventing backdraft. In the ceiling 3 where the duct 51 meet the ducts 52 is provided a fan 8 and a baffle plate 10 that can obstruct the communication between the ducts 51 and 52. These fan and baffle plate are controlled by a switch 81 located in the room 9.

As embodied herein, ducts 52 are communicated with exhaust air inlets 11 which in turn are in communication with the room 9. At the lower side of the wall is further provided a fresh air supply duct 53 which is in communication with a fresh air inlet 12 and fresh air supply ports **53*a* for supplying fresh air into the room. Adjacent to the air inlet 12 is further provided a device 13. There is further provided a vertical duct 54 which extends from the first storey to the second storey. It is not communicated with horizontal ducts 52 but is communicated with ducts 53. The device 13 is located where the duct 54 meets the air supply ducts 53. At the top of the duct 54 is also provided a device 7**.

Figure 2:
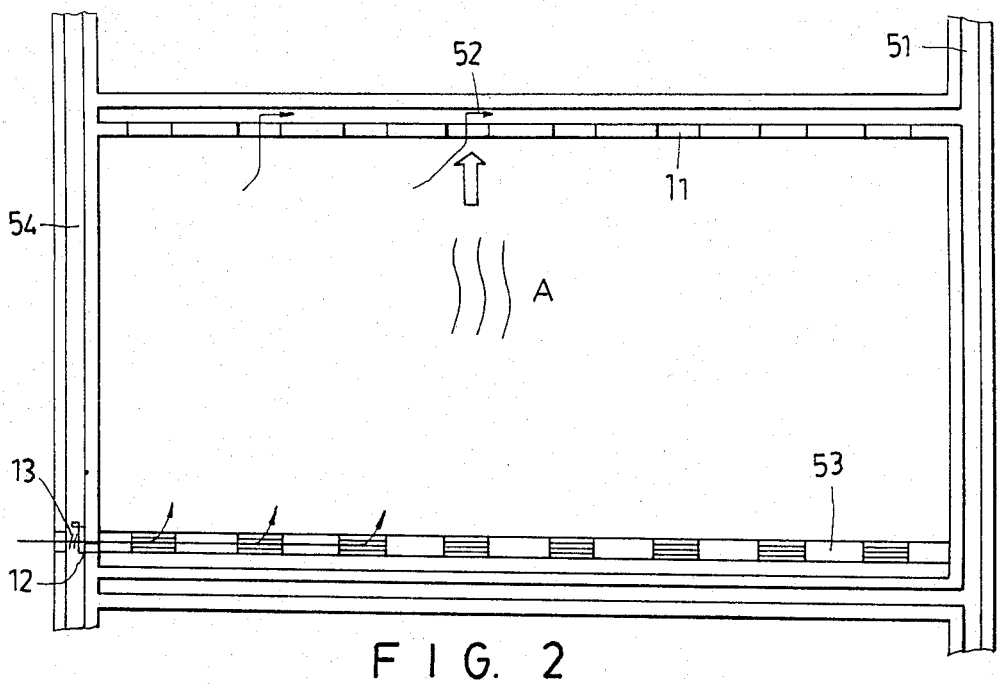
FIG. 2 is a schematic view illustrating the operation of the ventilation system.

The operation of the above ventilation system will be described hereinunder with reference to FIG. 2. Since the room air A is warmed by hot electric appliances, the human body and the like, there are differences in density and pressure between the room air and the atmosphere. The warm air which is lighter rises into the exhaust air discharge ducts 52 and 51 through exhaust air inlets 11.

Figure 3:
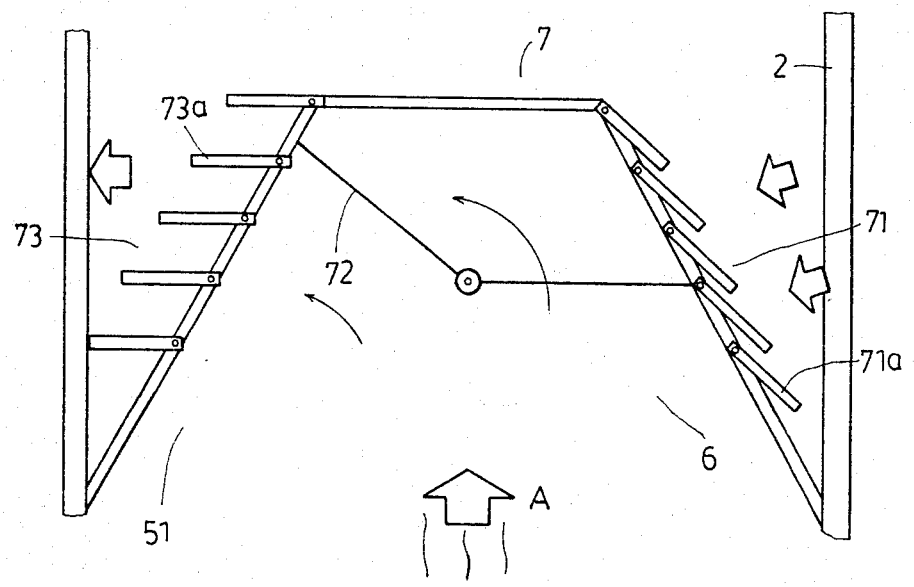
FIG. 3 is a schematic view illustrating means for preventing backdraft provided at the exhaust air outlet.

The device 7 includes a roof-shaped member, as shown in FIG. 3, which has two opposite flow regulating arrangements 71 and 73 having a plurality of overlapping slats **71*a* and 73*a* respectively. The arrangements 71 and 73 are connected by a connecting member 72 in such a manner that when one arrangement is fully closed another one will be fully opened. Normally, the device 7 which prevents backdraft at the outlets 6 has its one of the arrangement, which face the direction of the wind, closed and the remaining one open. The exhaust air can escape through the fully opened slats 73*a* of arrangement 73** without facing any current of air that resist it.

Generally the rate of the exhaust air drawn through the inlet 11 which is nearer the duct 51 is greater than that which is farther from the duct 51. Since the exhaust air escapes at a certain rate at the outlet 6, the exhaust air that flows through the inlet 11 at a lower rate has only a little change to escape, thereby resulting in a poor ventilation in the area which is farther from the duct 51.

To avoid the above disadvantages, there are further provided plug members 110 in the exhaust air inlets 11 for regulating the rate of the exhaust air flowing therethrough. The plug may be a truncated cone shaped member which can be lowered or lifted by turning the screws 112 to adjust the access to the exhaust air, as shown in FIG. 4A. The plug members 110 are so arranged that the nearer the inlets 11 from the duct 51, the smaller the access is made. This reduces the rate of the exhaust air through the inlets 11 which is nearer the duct 51 and makes uniform the rates of the exhaust air that flow through all inlets 11.

Alternatively, the rate of exhaust air at the inlet 11 can be regulated by providing baffle plates 111 at the inlet 11 to reduce the rate of the air flow as shown in FIG. 4B. The inlet 11 which is the farthest from the duct 51 need not be provided with the baffle plate. However, to regulate the rate of the air flow, the former and the latter methods can be used in combination, as shown in FIG. 4C.

Figure 5:
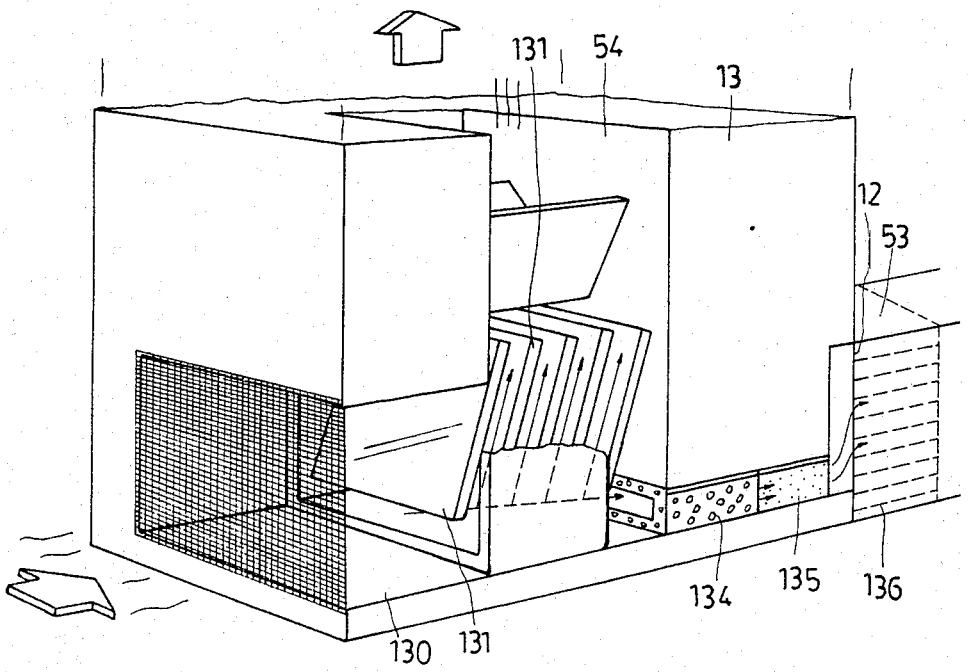
FIG. 5 is a schematic view illustrating the device provided at the fresh air inlet for regulating the entering fresh air.

Referring again to FIGS. 2 and 5, when the warm air A is drawn through the inlets 11, the fresh air enters into the room from the fresh air supply ports 53*a*. The fresh air is drawn into the fresh air supply duct 53 through a device 13 and an inlet 12.

The device 13 includes an entrance 130 for the air, damper plates 131 at the duct 54, a noise absorber 134, an air filter 135 and a plurality of water pans 136. When the entering air passes the damper plates 131, a warm portion of the entering air is directed to the duct 54 and the device 7 from which it is discharged and the cold portion is directed to pass through the member 134, 135 and 136 and then enter into the fresh air supply duct 53.

It can be appreciated that the above described ventilation system is provided by natural convection in which the warm or less density air is delivered out of the room and a current of cold air is drawn into the room.

However, in case of a necessity for supplying a speedier air circulation in the room, the fan 8 can be actuated by pushing the switch 81 on.

Referring again to FIG. 1, there is further provided a fire security room 14 provided in the first storey. The exhaust air inlet 11 in the ceiling of the room 14 are provided with baffle plates 15 which are used to obstruct the air flow. If the building is fired, the communication between the exhaust air ducts 52 and duct 51 is obstructed by turning the switch 81 off to close the baffle plate 10 and the communication between the fresh air inlet 12 and the fresh air supply duct 53 is obstructed by pushing the switch 82 off. As a result, the natural ventilation is stopped and the fire is automatically extinguished because of the shortage of air or oxygen. The people may enter in the security room 14, closing the exhaust air inlet 11 with the baffle plate 15 for preventing the entering of the flame and allowing the fresh air to enter the room 14 from the fresh air inlet 160 through the passage 16.

Since the ventilating system includes device 13 and 7 at the fresh air inlet and at the exhaust air outlet respectively. The system provide an adequate ventilation for an enclosed occupied space. Due to the the presence of the device 7, no resistance will oppose against the flow of the exhaust air, thereby rendering the exhaust air to escape smoothly and completely and resulting in an effective suction of fresh air into the room. The suctioned air is noiseless, cold and clean since it passes through the device 13 which include damper plates, noise absorber, air filter and water pans. It can be noted that the current of air that enters the room does not recircled after it escapes.

With the invention thus explained, it is apparent that obvious modifications and variations can be made without departing from the scope of the invention. It is therefore intended that the invention be limited only as indicated in the appended claims.

I claim:

1. A ventilation system for an enclosed occupied space defined by hollow walls and a ceiling comprising a fresh air inlet and a fresh air passage provided in the lower side of the walls, said fresh air passage having a plurality of fresh air outlet for supplying fresh air into the space, a plurality of exhaust air inlets provided in the ceiling of the space, a first exhaust air discharge passage communicated with said exhaust air inlets and lying in the ceiling, a second exhaust air discharge passage communicated with said first discharge passage and lying in the wall, an exhaust air outlet at the top of said second exhaust air passage, means for preventing backdraft at the exhaust air outlet, said means including a roof-shaped member having a first and a second flow regulating arrangement each of which has a plurality of overlapping slats for opening and closing said air outlet, the first and second flow regulating arrangement being so arranged that when one of them is fully closed, the other will be fully opened.

2. A ventilation system as claimed in claim 1, further comprising a fan provided where the first and second exhaust air discharge ducts meet.

3. A ventilation system as claimed in claim 2, further comprising means for obstructing the communication between the first and second exhaust air discharge passages.

4. A ventilation system as claimed in claim 3, further comprising a device provided at the fresh air inlet, the device including damper plates, an air filter, a noise absorber, and water pans.

5. A ventilation system as claimed in claim 4, in which the enclosed occupied space includes a fire security room and wherein the system further comprising a fresh air supply duct for the security room which is communicated with the fresh air inlet.

6. A ventilation system as claimed in claim 4, the system further comprising means for regulating the air flow at the exhaust air inlets.

7. A ventilation system as claimed in claim 6, wherein said means includes truncated cone-shaped plug member for the exhaust air inlets.

8. A ventilation system as claimed in claim 6, wherein said means includes baffle plate at the exhaust air inlets.

* * * * *